United States Patent [19]

Yoshida et al.

[11] 4,184,518

[45] Jan. 22, 1980

[54] APPARATUS FOR MANUFACTURING A SLIDE FASTENER STRINGER HAVING A WOVEN COILED ELEMENT

[75] Inventors: Hiroshi Yoshida, Uozu; Masaatsu Ofusa, Kurobe, both of Japan

[73] Assignee: Yoshida Kogyo K.K., Tokyo, Japan

[21] Appl. No.: 936,749

[22] Filed: Aug. 25, 1978

[30] Foreign Application Priority Data

Aug. 27, 1977 [JP] Japan ..... 52-102825

[51] Int. Cl.[2] ..... D03D 1/00; D03D 41/00

[52] U.S. Cl. ..... 139/35; 29/766

[58] Field of Search ..... 29/408, 766, 769; 24/205.01 C, 205.13 C, 205.16 C; 139/11, 35, 116, 384 B

[56] References Cited

U.S. PATENT DOCUMENTS

| | | | |
|---|---|---|---|
| 3,765,457 | 10/1973 | Glindmeyer et al. | 139/35 |
| 3,791,417 | 2/1974 | Glindmeyer et al. | 139/11 |
| 3,827,463 | 8/1974 | Glindmeyer et al. | 139/35 |
| 3,828,825 | 8/1974 | Glindmeyer et al. | 139/35 |
| 3,921,679 | 11/1975 | Glindmeyer et al. | 139/384 B |
| 3,941,163 | 3/1976 | Glindmeyer et al. | 139/384 B |
| 3,945,405 | 3/1976 | Takamatsu | 139/116 X |
| 3,982,566 | 9/1976 | Glindmeyer et al. | 139/35 |
| 4,098,299 | 7/1978 | Frohlich | 139/384 B |
| 4,126,158 | 11/1978 | Scott | 139/384 B |
| 4,127,147 | 11/1978 | Frohlich | 139/11 |

*Primary Examiner*—Ervin M. Combs

*Attorney, Agent, or Firm*—Hill, Van Santen, Steadman, Chiara & Simpson

[57] ABSTRACT

An apparatus for manufacturing a slide fastener stringer having a woven coiled fastener element includes a coiling rotor assembly for winding a monofilament orbitally around a mandrel extending substantially warpwise so as to shape the monofilament into a helical coil which, as the fastener element, is interlaced with weft threads as they are woven with warp threads to produce the slide fastener stringer. The rotor assembly comprises a first and a second wheel rotatable respectively on a first and a second floating shaft interconnected by a connecting rod out of coaxial alignment with each other, the first shaft being located adjacent to the warp threads and supporting the mandrel. The wheels have means for guiding the monofilament to turn in an orbital motion during revolution of the wheels. The second shaft supports a core thread bobbin from which a core thread is drawn off through the second shaft, the connecting rod, and the first shaft for extending along the mandrel so as to be inserted through the coiled fastener element.

11 Claims, 4 Drawing Figures

APPARATUS FOR MANUFACTURING A SLIDE FASTENER STRINGER HAVING A WOVEN COILED ELEMENT

BACKGROUND OF THE INVENTION

1. Field of the Invention

The present invention relates to an apparatus for manufacturing a slide fastener stringer including a woven stringer tape and a coiled fastener element woven into the stringer tape along a longitudinal edge thereof.

2. Prior Art

Known apparatus for producing a slide fastener stringer of the type described above generally comprise a shuttleless loom such as a needle loom for weaving a stringer tape and a rotor assembly operatively associated with the loom for supplying a monofilament and a core thread, the rotor assembly including a mandrel for extending along a longitudinal edge of the tape being formed and adjacent to the fell of the tape. The rotor assembly winds or coils the monofilament around the mandrel and the core thread fed therealong, thereby forming the coiled fastener element reinforced with the core thread as they are woven into the tape by being interlaced with weft threads inserted by filling carriers of the loom.

The rotor assembly comprises a housing, a wheel or rotor rotatable in the housing and having an axial off-center hole through which the monofilament passes, and a shaft around which the wheel is rotatable, the mandrel being fixed to the shaft. Since during operation of the apparatus the wheel revolves so as to turn the monofilament in an orbital motion around the shaft, the shaft floats in the wheel and hence cannot be non-rotatably maintained. Therefore, the shaft is liable to be turned about its own axis due primarily to frictional engagement with the wheel and to vibrations set up in the apparatus while it is being operated. Such rotational movement of the shaft causes the eccentrically disposed mandrel to shift sideways, in which instance the monofilament being coiled can be shaped irregularly and the weft threads being inserted tend to get loosened at the tape edge.

SUMMARY OF THE INVENTION

A coiling rotor assembly in the apparatus comprises first and second wheels rotatable in first and second housings, respectively, and first and second floating shafts around which the first and second wheels are rotatable, respectively, the first shaft fixedly supporting a mandrel thereon. The first wheel is located closer to the warp threads than the second wheel is so that the mandrel can extend substantially along the longitudinal edge of the tape being formed. The first and second shafts are coupled by means of a hollow elongate member through which a core thread is supplied from a bobbin supported on the second shaft, the axes of the shafts being out of mutual alignment whereby the shafts are held nonrotatable. The wheels have means for guiding a monofilament and are synchronously rotatable to coil the monofilament orbitally around the mandrel and the core thread.

It is an object of the present invention to provide an apparatus for manufacturing a slide fastener stringer with a woven coiled fastener element, the apparatus having a mandrel that is maintained stably during operation.

Another object of the present invention is to provide an apparatus for manufacturing a slide fastener stringer with a woven coiled fastener element, the apparatus having a rotor assembly for winding a monofilament as smoothly and undistortedly into the coiled element as possible.

Still another object of the present invention is to provide an apparatus for manufacturing a slide fastener stringer with a woven coiled fastener element, the apparatus being capable of accommodating a bobbin of relatively large capacity for carrying a core thread to extend through the fastener element.

Many other advantages, features and additional objects of the present invention will become manifest to those versed in the art upon making reference to the detailed description and the accompanying drawings in which preferred structural embodiments incorporating the principles of the present invention are shown by way of illustrative example.

DETAILED DESCRIPTION

Figure 1:
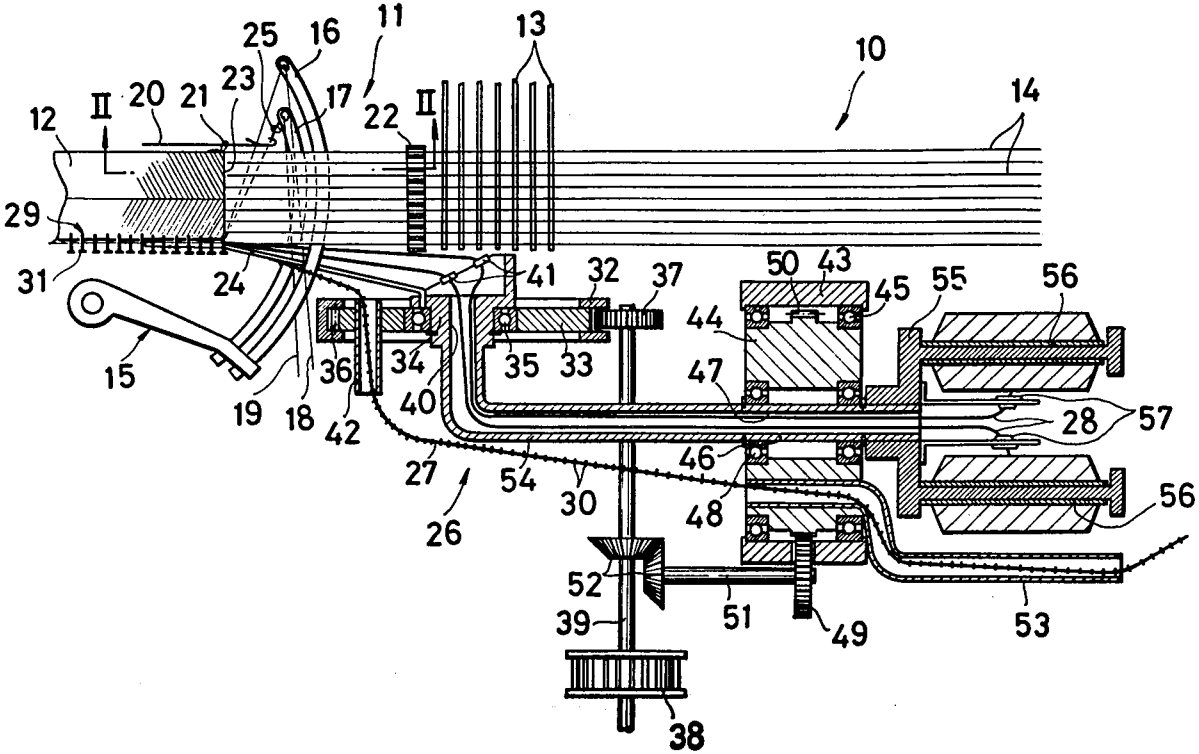
FIG. 1 is a plan view partly in cross section of an apparatus constructed in accordance with an embodiment of the present invention.

The principles of the present invention are particularly useful when embodied in an apparatus such as shown in FIG. 1, generally indicated by the numeral 10.

The apparatus 10 includes a needle loom 11 of a known construction for producing a narrow, continuous slide fastener stringer tape 12, the loom 11 essentially comprising a plurality of harnesses 13 for forming sheds by raising and lowering warp threads 14 selectively, a weft inserter 15 having a pair of upper and lower filling carriers 16, 17 and pivotally movable for enabling the filling carriers 16, 17 to insert respective weft threads 18, 19 through the warp sheds, a latch needle 20 reciprocable in warp direction alongside of one longitudinal edge of the tape 12 for catching and knitting the weft thread 19 carried by the filling carrier 17 so as to form a tape selvage 21 along said longitudinal tape edge, and a reed 22 for beating the weft thread 19 into the fell 23 of the tape 12.

Figure 2:
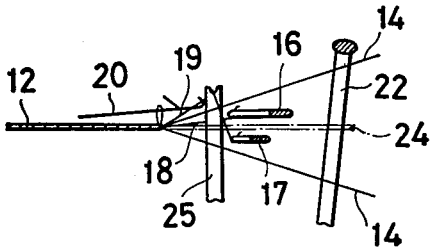
FIG. 2 is a cross-sectional view taken along line II—II of FIG. 1.

As shown in FIG. 2, the filling carriers 16, 17 are vertically spaced from each other to allow a mandrel or coiling needle 24 to extend therebetween. A vertically reciprocable weft lifter 25 is located adjacent to the fell 23 and, when the filling carrier 17 is fully inserted across the warp shed, is movable upwardly to engage and raise the weft thread 19 beyond the weft thread 18 so that the latch needle 20 can catch the weft thread 19 reliably.

The apparatus 10 of FIG. 1 further includes a coiling rotor assembly 26 disposed alongside of the warp shed for supplying a monofilament 27 and a pair f core threads 28, 28 and for winding or coiling the monofilament 27 around the mandrel 24 so as to shape the monofilament 27 into a helically coiled fastener element 29 to be disposed along the tape edge remote from the selvage edge 21. The monofilament 27 is made of plastic material and has a plurality of widened portions 30 spaced at predetermined intervals therealong, such portions 30 being formed as by stamping. The widened portions 30 permit the monofilament 27 to be bent or folded over easily at such portions when the monofilament 27 is being coiled, and alternate widened portions 30 function as coupling heads 31 of the element 29. The rotor assembly 26 includes a first housing 32 fixed to a base (not shown), a first wheel or rotor 33 rotatably mounted in the first housing 32, and a first floating shaft 34 having a ball bearing 35 around which the wheel 33 is rotatable. The wheel 33 has a set of peripheral teeth 36 with which a drive gear 37 meshes for driving the wheel 33, the gear 37 being rotatable by a pulley 38 through an axle 39. The shaft 34 has a coaxial through hole 40 and supports thereon a pair of guide rings 41, 41 located adjacent to the shaft hole 40 for the passage therethrough of the core threads 28, 28, respectively.

The mandrel 24 is supported on the first floating shaft 34 and extends rearwardly therefrom substantially along the warp threads 14 toward the fell 23 of the tape 12, the mandrel 24 having a free end portion extending beyond the fell 23 parallel and adjacent to the longitudinal tape edge that is remote from the tape selvage 21. The wheel 33 is disposed parallel to and as closely to the warp threads 14 as physically possible so that the mandrel 24 extends substantially in the direction of the warp. The wheel 33 has a tubular guide 42 extending axially therethrough at an eccentric position, for the monofilament 27 to pass therethrough. As the wheel 33 is rotated, the guide 42 revolves around the shaft 34 to enable the monofilament 27 to turn in an orbital motion around the mandrel 24 as described below.

The rotor assembly 26 further comprises a second housing 43 secured to the unshown base and spaced from the first housing 32, a second wheel 44 rotatable on an outer ball bearing 45 mounted within the second housing 43, and a second floating shaft 46 having an axial through hole 47, around which the second wheel 44 is rotatable on an inner ball bearing 48 disposed therebetween. The second wheel 44 is driven by a drive gear 49 meshing with a set of peripheral teeth 50 on the wheel 44, the gear 49 being supported on an axle 51 which is rotated by the pulley 38 through a pair of intermeshing bevel gears 52, 52 one on the axle 39 and one on the axle 51. The second wheel 44 has an off-center tubular guide 53 through which is threaded the monofilament 27 supplied from a suitable storage bobbin or spool (not shown).

Extending between and integral with the shafts 34, 46 is a hollow elongate member or tube 54 of an L shape having open ends held in registry with the axial holes 40, 47 in the shafts 34, 46. The second shaft 46 supports thereon a bobbin mount 55 on which are rotatably carried a pair of bobbins 56, 56 around which the core threads 28, 28 are wound, the core threads 28, 28 being drawn out via guides 57, 57 through the shaft hole 47, the tube 54, and the shaft hole 40 for extending along the mandrel 24.

With the L-shaped tube 54, the shafts 34, 46 have their own axes disposed at a right angle to each other and are prevented from rotation and vibration due to the revolving wheels 33, 44. Because the second wheel 44 is spaced apart from the first wheel 33 and thus remotely from the weaving machine members such as the harnesses 13, reed 22, and weft inserter 15, the bobbins 56, 56 mounted on the second shaft 46 may be of a relatively large capacity that makes their replacement less frequent.

The tubular guides 42, 53 have extensions projecting away from the wheels 33, 44, respectively, the extensions allowing the monofilament 27 to move in an oribit clear of any obstructions during revolution of the wheels 33, 44.

Figure 4:
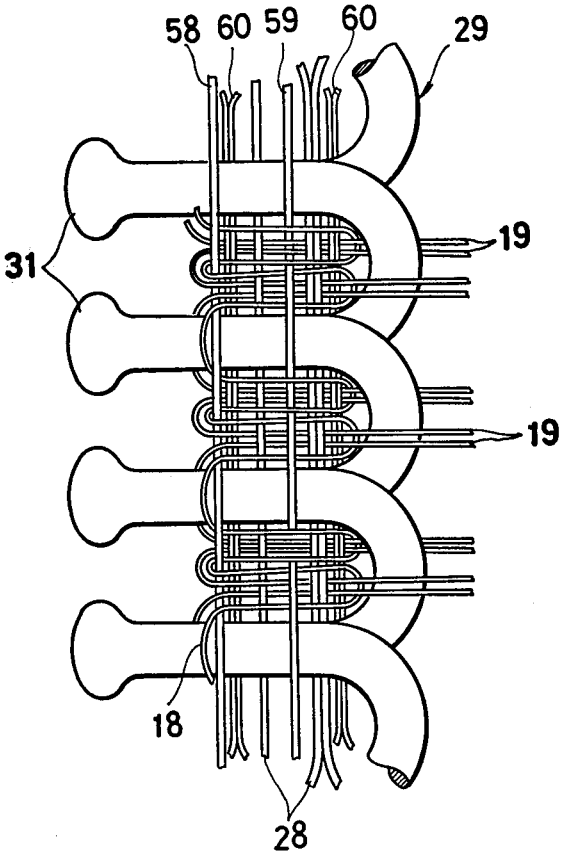
FIG. 4, appearing with FIG. 2, is an enlarged fragmentary view of a longitudinal edge of a slide fastener stringer produced on the apparatus of the invention, the longitudinal edge including a woven coiled fastener element.

The apparatus 10 thus constructed functions in the following manner. As the stringer tape 12 is progressively woven of the warp threads 14 and the weft thread 19, the first and second wheels 33, 44 are synchronously rotated by the gears 37, 49, respectively, in timed relation to the movement of the weft inserter 15 to wind the monofilament 27 around the mandrel 24 and the core threads 28, 28 to form the coiled fastener element 29, which is then interlaced with the weft threads 18, 19 so as to be woven into the stringer tape 12 along the longitudinal edge thereof. The weft threads 18, 19 are both inserted through the warp shed, but only the weft thread 19 introduced by the filling carrier 17 is caught by the latch needle 20 upon being raised by the lifter 25, the weft thread 18 being disposed only in and along the longitudinal tape edge in which the fastener element 29 is woven as best shown in FIG. 4. The weft threads 18, 19 jointly fasten the fastener element 29 to the tape edge. The tape edge includes additional warp threads 58, 59 and 60 that assist in maintaining the fastener element 29 in position on the tape edge. The inclusion of such additional threads 58, 59, and 60 and the way in which they are shed and interlaced with the weft thread 19 are well known in the art and therefore have not been described in detail.

During rotation of the wheels 33, 44, the mandrel 24 is held stably in position because it is mounted on the first shaft 34 which is coupled to the second shaft 46 by way of the L-shaped member 54 that suppresses rotational and vibrational movements of the shafts 34, 46 around which the wheels 33, 34 revolve, respectively. The mandrel 24 that is maintained stationarily can be located reliably between the filling carriers 16, 17 without accidental collisions therewith during their motion across the warp sheds, and allows the monofilament 27 to be coiled therearound accurately. Since the mandrel 24 extends substantially in the warp direction, the monofilament 27 can be coiled smoothly and undistortedly in a conical orbit near the warp shed without being bent sharply adjacent to the fell 23 while the monofilament 27 is being wound around the mandrel 24. With the arrangements thus constructed, the apparatus 10 can be operated at higher speed than conventional machines, thereby resulting in greatly increased productive capacities.

Figure 3:
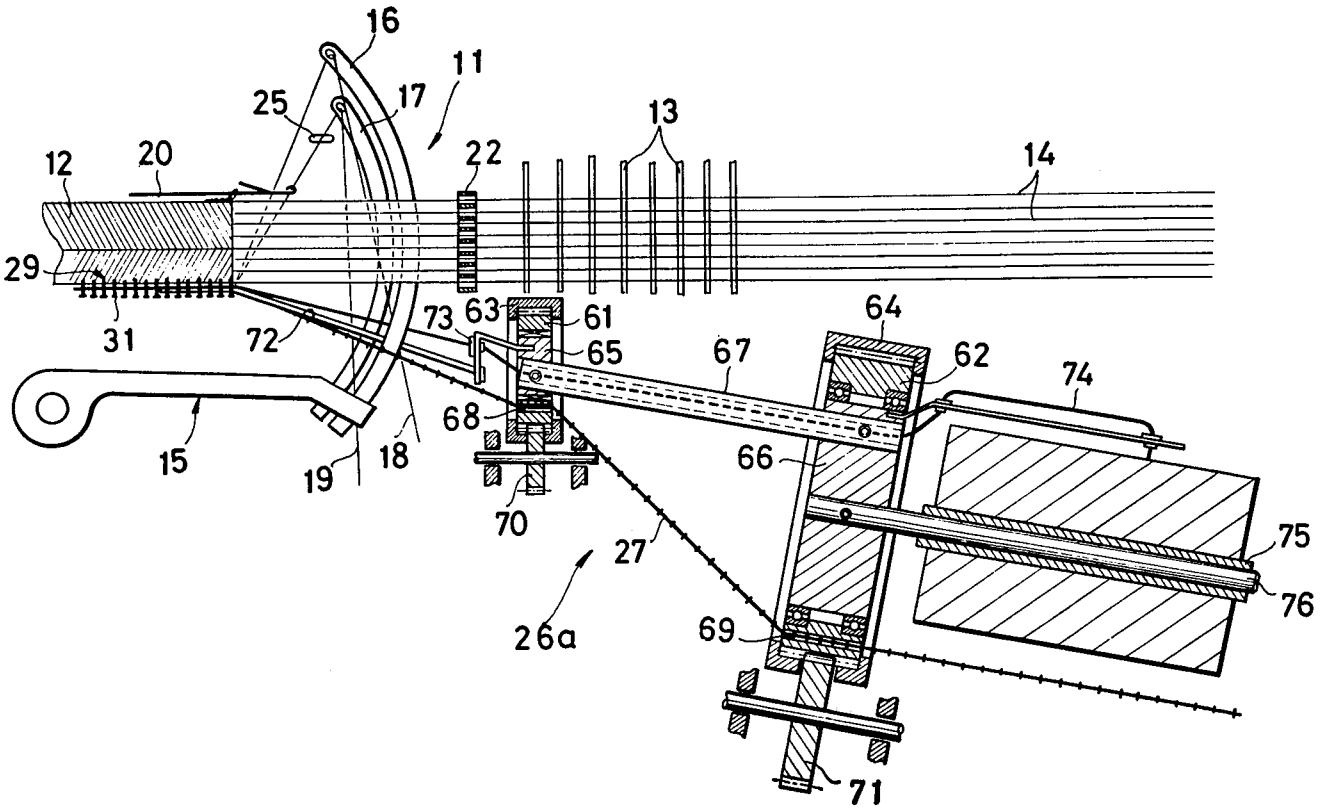
FIG. 3 is a plan view partly in cross section of an apparatus according to another embodiment.

FIG. 3 shows another embodiment of a coiling rotor assembly 26*a* which includes a pair of first and second wheels or rotors 61, 62 rotatably disposed respectively in a pair of first and second housings 63, 64, the first rotor 61 being located closer to the warp threads 14 than the second rotor 62 is. The first rotor 61 has an outside diameter smaller than that of the second rotor 62. The first and second rotors 61, 62 are rotatable around a pair of first and second floating shafts 65, 66, respectively, that are coupled together by a substantially straight elongate tube 67 having its ends secured to the shafts 65, 66 at eccentric locations, the tube 67 extending at an angle to the axis of the first shaft 65 but substantially parallel to that of the second shaft 66.

Accordingly, the axes of the shafts 65, 66 are inclined relatively to each other. With the shafts 65, 66 thus fixed to each other, they are immovably held within the rotors 61, 62 while they are revolving. In addition, the first rotor 61, being diametrically small relatively to the second rotor 62 is conducive to the stable disposition of the first shaft 65 during operation of the rotor assembly 26*a*. The shats 65, 66 have a pair of eccentric axial holes 68, 69, respectively, through which passes the monofilament 27 that revolves in an orbital motion during synchronous rotation of the wheels 61, 62 respectively driven by a pair of gears 70, 71. The first shaft 65 supports a mandrel 72 and a guide ring 73 through which there is supplied a core thread 74 coming through the tube 67 from a bobbin 75 rotatably mounted on a bobbin support 76 fixed to the second shaft 66. With the device constructed as illustrated in FIG. 3, the shafts 65, 66 are immovably held by the connecting tube 67 within the revolving rotors 61, 62, thereby maintaining the mandrel 72 in position against unwanted vibratory movements.

Although various minor modifications may be suggested by those versed in the art, it should be understood that we wish to embody within the scope of the patent warranted hereon, all such embodiments as reasonably and properly come within the scope of our contribution to the art.

We claimed:

1. An apparatus for manufacturing a slide fastener stringer including a stringer tape, woven of warp and weft threads, and a coiled fastener element woven into the stringer tape along a longitudinal edge thereof, comprising:

(a) means for weaving the stringer tape, said means including means for shedding warp threads and a filling carrier for inserting a weft thread through the warp shed;

(b) a mandrel for extending substantially along the warp threads, said filling carrier being reciprocable across said mandrel; and (c) a rotor assembly for winding a monofilament around said mandrel to form the coiled fastener element woven into the tape by the weft thread, said rotor assembly comprising first and second spaced housings, first and second wheels rotatably mounted in said first and second housings, respectively, said first and second wheels having means for guiding the monofilament, first and second floating shafts around which said first and second wheels are rotatable, respectively, said mandrel being supported on said first shaft, means coupling said first and second shafts with their axes out of mutual alignment whereby said shafts are held nonrotatable during rotation of said wheels, and means for synchronously rotating said first and second wheels, said first wheel being locatable closer to the warp threads than said second wheel is.

2. An apparatus according claim 1, including a bobbin mount supported on said second shaft for rotatably carrying a bobbin around which a core thread is wound, said first and second shafts having axial holes through which the core thread can be drawn out for extending along said mandrel.

3. An apparatus according to claim 2, said coupling means comprising a hollow elongate member connected to said shafts and having open ends held in registry with said axial holes for the passage therethrough of the core thread.

4. An apparatus according to claim 3, said hollow elongate member being substantially straight.

5. An apparatus according to claim 3, said hollow elongate member having an L shape.

6. An apparatus according to claim 1, said coupling means comprising an elongate member connected at its ends to said shafts in coaxial relation therewith.

7. An apparatus according to claim 1, said coupling means comprising an elongate member connected at one end to one of said shafts at an angle to the axis of said one shaft and at the other end to the other of said shafts substantially parallel to the axis of said other shaft.

8. An apparatus according to claim 1, the axis of said shats extending at an angle to each other.

9. An apparatus according to claim 8, said angle being substantially a right angle.

10. An apparatus according to claim 1, said monofilament guiding means comprising tubular members axially extending through said wheels, respectively.

11. An apparatus according to claim 1, said first wheel having an outside diameter smaller than that of said second wheel.

* * * * *